United States Patent [19]

Miyauchi

[11] Patent Number: 4,614,956

[45] Date of Patent: Sep. 30, 1986

[54] HEAT-SENSITIVE RECORDING SHEET

[75] Inventor: Masahiro Miyauchi, Funabashi, Japan

[73] Assignee: Mitsubishi Paper Mills, Ltd., Tokyo, Japan

[21] Appl. No.: 741,905

[22] Filed: Jun. 6, 1985

[30] Foreign Application Priority Data

| | | | |
|---|---|---|---|
| Jun. 7, 1984 | [JP] | Japan | 59-116941 |
| Oct. 12, 1984 | [JP] | Japan | 59-213781 |
| Oct. 18, 1984 | [JP] | Japan | 59-220048 |

[51] Int. Cl.[4] ..... B41M 5/18

[52] U.S. Cl. ..... 346/209; 346/200; 346/226; 427/152

[58] Field of Search ..... 346/200, 209, 226, 208; 427/150, 151, 152

[56] References Cited

FOREIGN PATENT DOCUMENTS 2119531A 11/1983 United Kingdom ..... 346/226

*Primary Examiner*—Bruce H. Hess

*Attorney, Agent, or Firm*—Cushman, Darby & Cushman

[57] ABSTRACT

In a heat-sensitive recording sheet comprising (1) a substrate, (2) a heat-sensitive color-developing layer provided on said substrate, composed essentially of a colorless or light-colored dye precursor and a color developer capable of allowing said dye precursor to develop a color by reacting with the dye precursor when heated and, as necessary, (3) an overcoat layer provided on said heat-sensitive color-developing layer, improvements in printability, storability, etc. can be obtained by allowing the heat-sensitive color-developing layer and/or the overcoat layer to contain a boric acid ester.

5 Claims, No Drawings

HEAT-SENSITIVE RECORDING SHEET

BACKGROUND OF THE INVENTION

1. Field of the Invention

This invention relates to a heat-sensitive recording sheet. More particularly, the present invention relates to a heat-sensitive recording sheet comprising (1) a substrate, (2) a heat-sensitive, color-developing layer provided on said substrate, composed essentially of a colorless or light-colored dye precursor and a color developer capable of allowing said dye precursor to develop a color by reacting with the dye precursor when heated and, as necessary, (3) an overcoat layer provided on said heat-sensitive, color-developing layer.

2. Description of the Prior Art

Thermal recording has many advantages such as it requires no impact and makes no noise during recording, neither development nor fixing is required and equipment maintenance is easy. Accordingly, it is used in many applications such as bar code labels, tickets and the like through means such as printers, facsimiles and the like.

Heat-sensitive papers used in thermal recording are firstly required to have a color development sensitivity which is appropriate for intended applications. In addition, they have various other requirements such as (1) their background is white, (2) the developed image is stable and does not disappear over a long period of time, (3) during recording, the heat-meltable components do not stick to a thermal head of a printer as work-ups and accordingly printing is not impaired and (4) also during printing, the heat-meltable components do not fuse to a thermal head and accordingly no difficulty of paper feeding arises and no noise is developed and no hindrance of image development (no sticking) occurs. Further, in coating of a heat-sensitive color-developing layer to produce a heat-sensitive paper, there should be no repellency, no pin hole and no unevenness. That is, the heat-sensitive color-developing layer should have an excellent levelling property because it can greatly contribute to printability. Furthermore, heat-sensitive papers should cause no blocking between the face of a paper and the back side of another paper when left in an "as wound-up" state after drying. When heat-sensitive papers are subjected to a finishing step by a super calender, the heat-sensitive layer should not cause partial sticking (dusting).

In heat-sensitive papers, for prevention of work-up formation, a pigment having a high oil absorption is generally used in the heat-sensitive color-developing layer, or, for prevention of sticking, a metallic soap is generally used in said layer. However, the use of such substances not directly participating in a color development reaction results in a dilution effect whereby the developed image density and/or the color development sensitivity of these heat-sensitive papers are/is reduced. Further, for prevention of repellency, pin holes and unevenness appearing at the time of coating a heat-sensitive color-developing layer to produce a heat-sensitive paper, various surfactants are being trially used in said layer; however, the use is not satisfactory because it causes (a) excessive infiltration into paper, (b) foaming and (c) deterioration in water resistance of the layer. Furthermore, for prevention of blocking and/or dusting, it is practised that the adhesive used for formation of heat-sensitive color-developing layer is made water-resistant; however, this operation can not be completed in a short time requiring 1 to 2 weeks because high temperatures can not be used in drying.

Also, in handling of heat-sensitive papers after recording, difficulty of reading of developed images due to disappearance of developed image or background fogging occurs when the papers come in contact with a rubber eraser or a polyvinyl chloride bag, both containing a large amount of a plasticizer, or when the papers are touched by hands stained with a hand cream or a hair oil, or when such a paper and a diazo type photosensitive paper are superimposed on each other right after development, or when a filling-in such as underlining is made with a fluorescent pen. This image disappearance phenomenon is believed to take place because the lactone ring of a color-forming lactone compound which has been opened by an acidic color-developing agent is closed in the presence of a plasticizer such as dibutyl phthalate, dioctyl phthalate, dioctyl adipate or the like. The fogging phenomenon is believed to take place because a solvent contained in a developing solution for diazo type photo-sensitive paper or in a fluorescent pen dissolves a color-developing agent and as a result the color-developing agent comes in contact with the dye precursor to develop a color.

It was disclosed in Japanese Patent Application Kokai (Laid-open) Nos. 128347/1979 and 3549/1979 that the above phenomena can be prevented by forming an overcoat layer on the heat-sensitive color-developing layer of a heat-sensitive recording paper because the formation of an overcoat layer prevents infiltration of a plasticizer into said paper.

An overcoat layer having chemical resistance was proposed by the present inventors in Japanese Patent Application Nos. 182557/1980 and 981/1981 (Japanese Patent Application Kokai (Laid-open) Nos. 105390/1982 and 115391/1982, respectively).

In formation of an overcoat layer according to the above conventional arts, however, there tended to exist repellency, pin holes, unevenness, etc. and thick coating was necessary to obtain satisfactory chemical resistance. This not only required a long time for drying, slowed the coating speed, which became problems in production, but also caused the decrease in the sensitivity of color development. Recently, a faster printing speed is being adopted and therefore it is necessary that any coating layer be made as thin as possible for smaller heat loss. Hence, improvements in repellency, pin holes, unevenness, etc. are a task to be urgently solved in view of requirements for coating layer.

In order to improve the levelling property of an overcoat layer, an attempt was made, as in the case of a heat-sensitive color-developing layer, to use various surfactants in an overcoat layer. However, the use greatly reduced the water resistance and oil resistance of the overcoat layer as well as the retainability of the quality of the background and recorded portions. The levelling property can be improved to some extent by the use of a pigment; however, the pigment can not be used in a large amount because the use induces hindrance of film formation, reduction of color development sensitivity and wear of a facsimile thermal head. Thus at the present stage, these approaches for improving the leveling property of an overcoat layer are not satisfactory.

SUMMARY OF THE INVENTION

An object of the present invention lies in prevention of work-ups, sticking and blocking as well as improvement of the quality of developed image, in heat-sensitive recording sheets consisting of a substrate and a heat-sensitive color-developing layer provided on the substrate.

Another object of the present invention lies in enhancement of water resistance and oil resistance, prevention of hindrance of color development and of sensitivity reduction, and improvement of the quality of developed image, in heat-sensitive recording sheets consisting of a substrate, a heat-sensitive color-developing layer provided on the substrate and an overcoat layer provided on the heat-sensitive color-developing layer.

These objects of the present invention has been achieved by, in a heat-sensitive recording sheet comprising (1) a substrate, (2) a heat-sensitive color-developing layer provided on said substrate, composed essentially of a colorless or light-colored dye precursor capable of allowing said dye precursor to develop a color by reacting with the dye precursor when heated and, as necessary, (3) an overcoat layer provided on said heat-sensitive color-developing layer, allowing the heat-sensitive color-developing layer and/or the overcoat layer to contain a boric acid ester.

Accordingly, the present invention relates to a heat-sensitive recording sheet comprising (1) a substrate, (2) a heat-sensitive color-developing layer provided on said substrate, composed essentially of a colorless or light-colored dye precursor and a color developer capable of allowing said dye precursor to develop a color by reacting with the dye precursor when heated and, as necessary, (3) an overcoat layer provided on said heat-sensitive color-developing layer, wherein the heat-sensitive color-developing layer and/or the overcoat layer contains a boric acid ester.

DETAILED DESCRIPTION OF THE INVENTION

The present invention is applied to a heat-sensitive recording sheet (I) comprising a substrate and a heat-sensitive color-developing layer provided on said substrate, as well as to a heat-sensitive recording sheet (II) comprising a substrate, a heat-sensitive color-developing layer provided on said substrate and an overcoat layer provided on said heat-sensitive color-developing layer. Hence, the present invention will be explained below in detail on each of the above two heat-sensitive recording sheets.

Heat-Sensitive Recording Sheet (I)

In the heat-sensitive recording sheet (I) of the present invention, since its heat-sensitive color-developing layer contains a boric acid ester, adhesion between the heat-sensitive color-developing layer and the substrate as well as the water resistance of the heat-sensitive color-developing layer are improved, whereby sticking, blocking and dusting are prevented, and the leveling property of the coating fluid is improved, whereby the quality of the developed image is enhanced.

As a typical example of the boric acid ester, there is mentioned an esterification product (A) between boric acid ($a_{11}$) or a tri(lower alkyl) borate ($a_{12}$) and at least one polyhydric alcohol having vicinal hydroxyl groups ($a_{12}$). The tri(lower alkyl) borate ($a_{12}$) is a triester of boric acid with a lower alcohol.

The esterification product (A) is known as an intermediate product obtained in the process of producing a surface-active organic boron compound which is disclosed in, for example, Japanese Patent Application Kokai (Laid-open) No. 8731/1973. As examples of the polyhydric alcohol having vicinal hydroxyl groups ($a_2$) which is reacted with boric acid ($a_{11}$) or a tri(lower alkyl) borate ($a_2$), there are mentioned ethylene glycol, propylene glycol, butylene glycol, glycerine, sorbitan, sorbitol, mannitol, etc. The tri(lower alkyl) borate ($a_{12}$) includes trimethyl borate, triethyl borate, tripropyl borate, triisopropyl borate, tributyl borate, etc.

As another example of the boric acid ester, there is mentioned a six-membered boric acid ester (B).

The six-membered boric acid ester (B) corresponds to an organic boron compound containing within the molecule a boric acid ester residue forming a six-membered ring which is disclosed in, for example, Japanese Patent Application Kokai (laid-open) No. 146485/1976, and it is typically represented by the general formula:

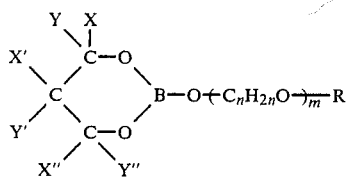

wherein X, X', X'', Y, Y' and Y'' each are a hydrogen atom, $CH_3$—, $C_2H_5$—, $C_3H_7$—, $CH_3O$—, $C_2H_5O$—, $CH_3OCH_2$— or $R'COOCH_2$— (R' is an alkyl group of 1 to 23 carbon atoms or an alkenyl group), R is an alkyl group of 1 to 24 carbon atoms, an alkenyl group, an aryl group, an alkylaryl group, an alkyloyl group, an alkenyloyl group, an aryloyl group or an alkylaryloyl group, n is 2, 3 or 4 and m is a positive number of 0 to 50. Preferable examples of the six-membered boric acid ester (B) include the following compounds.

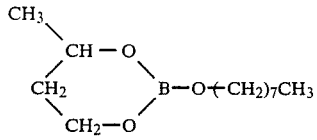

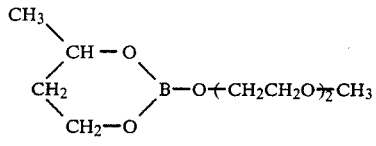

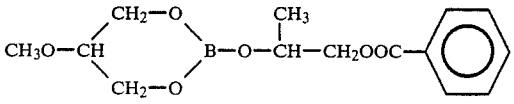

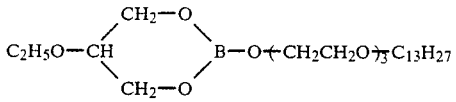

Of course, the boric acid ester may be a mixture of an esterification product (A) and a six-membered boric acid ester (B).

The esterification product (A) or the six-membered boric acid ester (B) contained in the heat-sensitive color-developing layer is highly compatible with water-soluble high molecular compounds also contained in said layer and resultantly provides an appropriate viscosity and further makes hydrophilic the surfaces of various hydrophobic substances contained in the heat-sensitive color-developing layer. As a result, adhesion of the heat-sensitive color-developing layer to the substrate is improved, and repellency, pin holes and unevenness at the time of formation of the heat-sensitive color-developing layer are prevented. As to water-resistance, the esterification product (A) or the six-membered boric acid ester (B) has a more rapid effect than polyamide resins, glyoxals, melamine resins, etc. and further with the compound (A) or (B), there is no fear of violent gelation as seen in boric acid. Therefore, the use of the esterification product (A) or the six-membered boric acid ester (B) in the heat-sensitive color-developing layer is effective in prevention of work-ups, sticking, blocking and dusting. Of course, the compound (A) or (B) may be used together with an ordinary water-resistant agent such as polyamide resins, glyoxyals, melamine resins, epoxy resins, etc.

As stated above, the heat-sensitive recording sheet (I) comprises a substrate and a heat-sensitive color-developing layer provided on said substrate, composed essentially of a colorless or light-colored dye precursor and a color developer capable of allowing said dye precursor to develop a color by reacting with the dye precursor when heated. As the dye precursor composing the heat-sensitive color-developing layer, there are mentioned triphenylmethane compounds, fluoran compounds, diphenylmethane compounds, thiazine compounds, spiropyran compounds, etc., all of which have been used conventionally. As typical examples of these compounds, there are Crystal Violet Lactone, 3-diethylamino-7-methylfluoran, 3-diethylamino-6-chloro-7-methylfuoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilianofluoran, 3-(N-methylcyclohexylamino)-3-methyl-7-anilinofluoran, 3-piperidino-3-methyl-7-anilinofluoran, etc.

As the color developer, there are used acidic substances generally used in heat-sensitive papers, and there are mentioned, for example, phenol, p-t-butylphenol, p-phenylphenol, naphthol, p-hydroxyacetophenone, 2,2'-dihydroxydiphenol, 4,4'-isopropylidene(2-t-butylphenol), 4,4'-isopropylidenediphenol, 4,4'-cyclohexylidenediphenol, novolak type phenol resins, benzoic acid, p-t-butylbenzoic acid, p-hydroxybenzoic acid, benzyl p-hydroxybenzoate and methyl p-hydroxybenzoate.

A binder is generally used in the heat-sensitive color-developing layer. As the binder, there are ordinarily mentioned water-soluble binders such as starches, hydroxyethyl cellulose, methyl cellulose, carboxymethyl cellulose, gelatin, casein, polyvinyl alcohols, modified polyvinyl alcohols, polyvinyl alcohol-acrylamide copolymers, styrene-maleic anhydride copolymers, ethylene-maleic acid anhydride copolymers and the like. Together with such a water-soluble binder, there may be used a water-insoluble binder in a latex form, such as a styrene-butadiene copolymer, an acrylonitrilebutadiene copolymer and a methyl acrylate-butadiene copolymer.

In the heat-sensitive color-developing layer, there are further used pigments such as diatomaceous earth, talc, kaolin, calcinated kaolin, calcium carbonate, magnesium carbonate, titanium oxide, zinc oxide, silicon oxide, aluminum hydroxide and an urea-formalin resin.

In the heat-sensitive color-developing layer, there can furthermore be used a metal salt of a higher fatty acid (e.g. zinc stearate, calcium stearate), a wax (e.g. a paraffin wax, an oxidized paraffin wax, a polyethylene, an oxidized polyethylene, stearamide, castor wax), a dispersing agent (e.g. sodium dioctylsuccinate), an ultraviolet absorber (e.g. benzophenone, benzotriazole), a surfactant, a fluorescent dye, etc.

As the substrate on which the heat-sensitive color-developing layer is provided, a paper is ordinarily used. Also, there can optionally be used an nonwoven cloth, a plastic film, a synthetic paper, a metal foil or a composite sheet which is their combination.

Heat-Sensitive Recording Sheet (II)

The heat-sensitive recording sheet (II) comprises (1) a substrate, (2) a heat-sensitive color-developing layer provided on said substrate and (3) an overcoat layer provided on said heat-sensitive color-developing layer. Therefore, the heat-sensitive recording sheet (II) can be regarded to virtually consist of a heat-sensitive recording sheet (I) and an overcoat layer provided thereon.

As the materials composing this overcoat layer, there are generally mentioned water-soluble high molecular compounds such as a salt of alginic acid, hydroxyethyl cellulose, methyl cellulose, carboxymethyl cellulose, a polyvinyl alcohol, modified polyvinyl alcohol, and polyvinyl alcohol-acrylamide copolymers. These compounds are used alone or in combination of two or more.

As necessary, there is further used effectively a film-forming emulsion of a high molecular compound such as a latex of an acrylic polymer, a vinyl type acrylic resin, a vinyl acetate-ethylene copolymer, a silicone-acrylate resin or a styrene-butadiene copolymer.

Furthermore, together with the above compounds, there are preferably used, alone or in combination of two or more, a water-resistant agent, an ultraviolet absorber and a releasing agent to allow the overcoat layer to have water resistance and light resistance in order to avoid peeling of the layer due to adhesion (blocking).

By allowing the overcoat layer to contain a boric acid ester, there was obtained a heat-sensitive recording sheet with enhanced water resistance and oil resistance, reduced hindrance of color development, increased color development sensitivity and improved quality of developed image.

As the boric acid ester, there can be used an esterification product (A), a six-membered boric acid ester (B) or their mixture, all of which are same as those used in the heat-sensitive recording sheet (I).

The esterification product (A) or the six-membered boric acid ester (B) contained in the overcoat layer is highly compatible with water-soluble high molecular compounds also contained in said layer and as a result provides an appropriate viscosity and further makes hydrophilic the surfaces of various hydrophobic substances contained in the overcoat layer. Therefore, adhesion of the overcoat layer to the heat-sensitive color-developing layer is improved and, as a result, repellency, pin holes and unevenness at the time of formation of the overcoat layer are prevented. Of course, with the addition of the boric acid ester, there occurs no deterioration of water resistance or oil resistance as seen with the addition of an surfactant, or no deterioration of color development sensitivity or printability as seen with the addition of a pigment. With the addition of a boric acid ester, the water resistance of the overcoat layer is improved to a considerable extext. With the boric acid ester, higher adhesion and water resistance is achieved than with boric acid employed in such an amount that it causes no gel formation.

In the heat-sensitive recording sheet (II), a boric acid ester can be contained both in the overcoat layer and in the heat-sensitive color-developing layer. In this case, the effects by the addition of the boric acid ester to the overcoat layer as well as the effects by the same addition to the heat-sensitive color-developing layer are obtained together.

Alternatively, in the heat-sensitive recording sheet (II), a boric acid ester can be contained only in the heat-sensitive color-developing layer, without adding the boric acid ester into the overcoat layer. In this case, there are obtained the same effects as those by the addition of the boric acid ester to the heat-sensitive color-developing layer in the heat-sensitive recording sheet (I).

The dye precursor, color developer, pigment and other additives composing the heat-sensitive color-developing layer of the heat-sensitive recording sheet (II) can be same as the respective counterparts of the heat-sensitive recording sheet (I).

In the heat-sensitive recording sheet (II), when a boric acid ester is contained only in the overcoat layer, there are used as the binder of the heat-sensitive color-developing layer, water-soluble binders such as starches, hydroxyethyl cellulose, methyl cellulose, carboxymethyl cellulose, gelatin, casein, polyvinyl alcohols, modified polyvinyl alcohols, styrene-maleic anhydride copolymers, ethylene-maleic anhydride copolymers and the like, as well as water-insoluble binders of latex type such as latexes of a styrene-butadiene copolymer, an acrylonitrile-butadiene copolymer, a methyl acrylate-butadiene copolymer and the like. These are used singly. However, water-soluble binders may be used in combination; latex type, water-insoluble binders, may be used in combination; and a water-soluble binder and a latex type, water-insoluble binder may be used together.

In the heat-sensitive recording sheet (II), when a boric acid ester is contained in the heat-sensitive color-developing layer (the ester may or may not be contained in the overcoat layer), there are used as the binder of the heat-sensitive color-developing layer, the previously mentioned water-soluble binders or their mixtures with the previously mentioned latex type, water-insoluble binders. The single use of the latex type, water-insoluble binders is not desirable.

As the substrate composing the heat-sensitive recording sheet (II), there can be used the same materials as used in the heat-sensitive recording sheet (I).

The present invention will be explained below in more detail by way of Examples. However, the present invention is by no means restricted to these Examples.

EXAMPLES 1

[Example of producing a heat-sensitive recording sheet (I)]

Fluid A

| | |
|---|---|
| 3-(N—methylcyclohexylamino)-6-methyl-7-anilinofluoran | 12 g |
| 10% by weight aqueous solution of a polyvinyl alcohol | 18 g |
| Water | 30 g |

Fluid B

| | |
|---|---|
| Benzyl p-hydroxybenzoate | 40 g |
| Benzyl terephthalate | 10 g |
| 10% by weight aqueous solution of a polyvinyl alcohol | 75 g |
| Water | 42 g |

Fluid A and fluid B were independently ground in a ball mill for 48 hr. Then, a coating fluid was prepared with the following recipe.

| | |
|---|---|
| Calcium carbonate | 20 g |
| Fluid A | 20 g |
| 15% by weight aqueous solution of polyvinyl alcohol/acrylamide copolymer (brand name: PAPIROL, manufactured by Showa Denko K.K.) | 46.7 g |
| Fluid B | 60 g |
| 30% by weight dispersion of zinc stearate | 12 g |
| 15% by weight aqueous solution of a triester of boric acid obtained from a dehydration reaction between boric acid (1 mole) and glycerine (2 moles) (brand name: EMULBON GB, manufactured by Toho Chemical Industries Co., Ltd.) | 5 g |
| 40% by weight aqueous solution of glyoxyal | 0.875 g |
| Water | 100 g |

The above coating fluid was coated on a 2 so that the coated amount after base paper of 49 g/m$^2$ so that the coated amount after drying became 5 g/m$^2$. The coated paper was passed through a super calender so as to have a Beck smoothness of 100 sec or more, whereby a heat-sensitive recording sheet was prepared.

Comparative Example 1

A heat-sensitive recording sheet was prepared in the same manner as in Example 1 except that the aqueous solution of a triester of boric acid was not used.

EXAMPLE 2

[Example of producing a heat-sensitive recording sheet (II)]

Fluid A

| | |
|---|---|
| 3-(N—methylcyclohexylamino)-6-methyl-7-anilinofluoran | 12 g |
| 10% by weight aqueous solution of a polyvinyl alcohol | 18 g |
| Water | 30 g |

Fluid B

| | |
|---|---|
| Benzyl p-hydroxybenzoate | 40 g |
| Benzyl terephthalate | 10 g |
| 10% by weight aqueous solution of a polyvinyl alcohol | 75 g |
| Water | 42 g |

Fluid A and fluid B were independently ground in a ball mill for 48 hr. Then, a coating fluid was prepared with the following recipe.

| | |
|---|---|
| Calcium carbonate | 20 g |
| Fluid B | 60 g |
| 10% by weight aqueous solution of a polyvinyl alcohol | 70 g |
| Fluid A | 20 g |
| Water | 60 g |

The above coating fluid was coated on a base paper of 49 g/m$^2$ so that the coated amount after drying became 5 g/m$^2$. The coated paper was dried for 1 min at 60° C. and then passed through a super calender so as to have a Beck smoothness of 100 sec or more, whereby a heat-sensitive recording sheet was prepared.

Fluid C

| | |
|---|---|
| 7% by weight aqueous solution of ammonium alginate (brand name: SNOW AMMON, manufactured by FUJI KAGAKU KOGYO K.K.) | 72 g |
| 15% by weight aqueous solution of a polyvinyl alcohol/acrylamide copolymer (brand name: PAPIROL, manufactured by SHOWA DENKO K.K.) | 40 g |
| 30% by weight dispersion of zinc stearate | 10 g |

Fluid D

| | |
|---|---|
| 90% by weight aqueous solution of a triester of boric acid obtained from a dehydration reaction between boric acid (1 mole) and glycerine (2 moles) (brand name: EMULBON GB, manufactured by TOHO CHEMICAL INDUSTRIES CO., LTD.) | 16.67 g |
| Water | 83.5 g |

An overcoat fluid was prepared by adding 30 g of fluid D to 122 g of fluid C. This overcoat fluid was coated on the previously prepared heat-sensitive recording sheet so that the overcoat layer had a thickness after drying of about 4 μm. Then, the resulting sheet was passed through a super calender so as to have a Beck smoothness of about 400 sec, whereby a heat-sensitive recording sheet having an overcoat layer was prepared.

COMPARATIVE EXAMPLE 2

A heat-sensitive recording sheet having an overcoat layer was prepared in the same manner as in Example 2 except that, as the overcoat fluid, only fluid C was used and fluid D was not added thereto.

EXAMPLE 3

[Example of producing a heat-sensitive recording sheet (II)]

Fluid A

| | |
|---|---|
| 3-(N—methylcyclohexylamino)-6-methyl-7-anilinofluoran | 12 g |
| 10% by weight aqueous solution of a polyvinyl alcohol | 18 g |
| Water | 30 g |

Fluid B

| | |
|---|---|
| Benzyl p-hydroxybenzoate | 40 g |
| Benzyl terephthalate | 10 g |
| 10% by weight aqueous solution of a polyvinyl alcohol | 75 g |
| Water | 42 g |

Fluid A and fluid B were independently ground in a ball mill for 48 hr. Then, a coating fluid was prepared with the following recipe.

| | |
|---|---|
| Calcium carbonate | 20 g |
| Fluid B | 60 g |
| 10% by weight aqueous solution of a polyvinyl alcohol | 70 g |
| Fluid A | 20 g |
| Water | 60 g |

The above coating fluid was coated on a base paper of 49 g/m$^2$ so that the coated amount after drying became 5 g/m$^2$. Then, the resulting sheet was dried for 1 min at 60° C. and passed through a super calendar so as to have a Beck smoothness of 100 sec or more, whereby a heat-sensitive recording sheet was prepared.

Fluid C

| | |
|---|---|
| 7% by weight aqueous solution of ammonium alginate (brand name: SNOW AMMON, manufactured by FUJI KAGAKU KOGYO K.K.) | 72 g |
| 15% by weight aqueous solution of a polyvinyl alcohol/acrylamide copolymer (brand name: PAPIROL, manufactured by SHOWA DENKO K.K.) | 40 g |
| 30% by weight dispersion of zinc stearate | 10 g |

Fluid D

| | |
|---|---|
| (Methoxyethyleneoxyethyl=butylene-1,3)=borate (brand name: EMULBON BBD, manufactured by TOHO CHEMICAL INDUSTRIES CO., LTD.) | 20 g |
| Water | 80 g |

An overcoat fluid was prepared by adding 30 g of fluid D to 122 g of fluid C. The overcoat fluid was coated on the previously prepared heat-sensitive recording sheet so that the coated layer had a thickness after drying of about 4 μm. Then, the resulting sheet was passed through a super calender so as to have a Beck smoothness of about 400 sec, whereby a heat-sensitive recording sheet having an overcoat layer was prepared.

COMPARATIVE EXAMPLE 3

A heat-sensitive recording sheet having an overcoat layer was prepared in the same manner as in Example 3 except that, as the overcoat layer, only fluid C was used and fluid D was not added thereto.

Test 1

Firstly, the test method used will be explained briefly.

Dusting test: At the time of preparation of the heat-sensitive recording sheets of Example 1 and Comparative Example 1, the pressure between rolls of the super calender was altered to observe the staining of metal roll surfaces due to peeling of the coated layer (4 $kg/cm^2$, 8 $kg/cm^2$ and 16 $kg/cm^2$).

Work-up and sticking test: The heat-sensitive recording sheets of Example 1 and Comparative Example 1 were subjected to printing by Panafax UF-920 manufactured by Matsushita Graphic Communication Systems Inc. to examine the amount of work-up formed on the thermal head, the sound and the hindrance of image development. The quality of developed image can also be checked by this test.

Next, the test results will be described. In the heat-sensitive recording sheet of Comparative Example 1, when the pressure between rolls of the super calender was as low as 4 $kg/cm^2$, there was no staining of roll, however, as the pressure increased to 8 $kg/cm^2$ and 16 $kg/cm^2$, the staining increased. Further, work-ups and sticking were present and the quality of developed image was hindered.

In contrast, in the heat-sensitive recording sheet of Example 1, not only when the pressure between rolls of the super calender was as low as 4 $kg/cm^2$ but also when the pressure was increased to 8 $kg/cm^2$ and 16 $kg/cm^2$, there was seen no dusting. Further, there was almost no work-up and no sticking and the quality of developed image was quite good.

Test 2

Firstly, the test method used will be explained.

Test for resistance to diazo developing solution:

The heat-sensitive recording sheets having an overcoat layer obtained in Example 2 and Comparative Example 2 were subjected to printing by Panafax UF-920 manufactured by Matsushita Graphic Communication Systems Inc. to allow the sheets to develop an image to an optical density of 1.20. Then, on the overcoat layers of these sheets were superimposed a diazo photo-sensitive paper right after being subjected to development by a developing solution (Brand name: Activator PD, manufactured by Bunshodou K.K.); they were allowed to stand for 3 min at room temperature; thereafter, fogging of the background portion and deterioration of the image portion were observed. Through this test, the chemical resistance of the overcoat layer, namely, the completeness of the overcoat layer can be grasped. If, in the background portion, there are points not covered by the overcoat layer, such points turn black by the action of the diazo developing solution, whereby the presence of repellency, pin holes and unevenness can be known.

Test for resistance to dioctyl phthalate:

The heat-sensitive recording sheets having an overcoat layer obtained in Example 2 and Comparative Example 2 were subjected to the same image development as mentioned above.

Dioctyl phthalate was allowed to adhere to the image portion and color fading of the portion was observed.

At the points not covered by the overcoat layer, color disappearance occurs momentarily right after adhesion of dioctyl phthalate, whereby the presence of repellency, pin holes and unevenness can be known.

Next, the test results will be described.

In the heat-sensitive recording sheet of Comparative Example 2, fogging of the background portion due to the developing solution for diazo photo-sensitive papers occurred partially and black points showing the presence of repellency, pin holes and unevenness were seen throughout the surface. Further, the image portion caused color fading due to dioctyl phthalate and, with the lapse of time, the color disappeared completely and reading of the developed letters became impossible.

In contrast, in the heat-sensitive recording sheet of Example 2, there was no deterioration of readability due to the developing solution for diazo photo-sensitive papers. Further, there were no black points showing the presence of repellency, pin holes and unevenness. Furthermore, there was no color fading of the image portion due to dioctyl phthalate.

Test 3

The heat-sensitive recording sheets having an overcoat layer obtained in Example 3 and Comparative Example 3 were subjected to test for resistance to diazo developing solution and test for resistance to dioctyl phthalate, same as those described in Test 2.

In the heat-sensitive recording sheet of Comparative Example 3, fogging of the background portion due to the developing solution for diazo photosensitive papers occurred partially and black points showing the presence of repellency, pin holes and unevenness were seen throughout the surface. Further, the image portion caused color fading due to dioctyl phthalate and, with the lapse of time, the color disappeared completely and reading of the developed letters became impossible.

In contrast, in the heat-sensitive recording sheet of Example 3, there was no deterioration of readability due to the developing solution for diazo photo-sensitive papers. Further, there was no black points showing the presence of repellency, pin holes and unevenness. Furthermore, there was no color fading of the image portion due to dioctyl phthalate.

What is claimed is:

1. A heat-sensitive recording sheet comprising (1) a substrate, (2) a heat-sensitive color-developing layer provided on said substrate, composed essentially of a colorless or light-colored dye precursor and a color developer capable of allowing said dye precursor when heated and, as necessary, (3) an overcoat layer provided on said heat-sensitive color-developing layer, wherein the heat-sensitive color-developing layer and/or the overcoat layer contain a boric acid ester, which is selected from the group consisting of an esterification product (A) between boric acid ($a_{11}$) or a tri)lower alkyl) borate ($a_{12}$) and at least one polyhydric alcohol having vicinal hydroxy groups ($a_2$), and a six-membered boric acid ester (B) represented by the general formula:

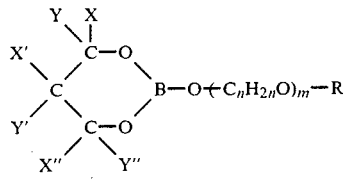

(I)

wherein X, X', X'', Y, Y', and Y'' each are a hydrogen atom, $CH_3$—, $C_2H_5$—, $C_3H_7$—, $CH_3O$—, $C_2H_5O$—, $CH_3OCH_2$— or $R'COOCH_2$—, R' is an alkyl group of 1 to 23 carbon atoms or an alkenyl group, R is an alkyl group of 1 to 24 carbon atoms, an alkenyl group, an aryl group, an alkylaryl group, an alkyloyl group, an alkenyloyl group, an aryloyl group, or an alkylaryloyl group, n is 2, 3, or 4 and m is a positive number of 0 to 50.

2. A heat-sensitive recording sheet according to claim 1, wherein the polyhydric alcohol ($a_2$) is selected from the group consisting of ethylene glycol, propylene glycol, butylene glycol, glycerine, sorbitan, sorbitol and mannitol.

3. A heat-sensitive recording sheet according to claim 1, wherein the tri(lower alkyl) borate ($a_{12}$) is selected from the group consisting of trimethyl borate, triethyl borate, tripropyl borate, triisopropyl borate and tributyl borate.

4. A heat-sensitive recording sheet according to claim 1, wherein the esterification product (A) is obtained by subjecting boric acid and glycerine to dehydration at a molar ratio of 1 (the former) to 2 (the latter).

5. A heat-sensitive recording sheet according to claim 1, wherein the six-membered boric acid ester represented by the general formula (I) is selected from the six-membered boric acid esters represented by the following formulas.

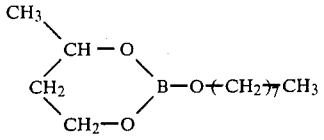

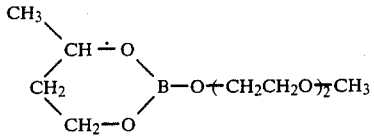

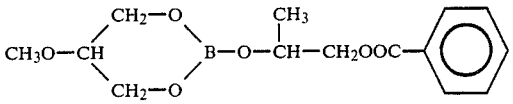

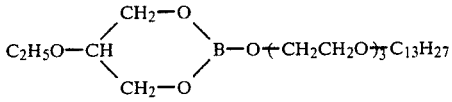

* * * * *